US010753309B2

(12) United States Patent
Ishiura et al.

(10) Patent No.: US 10,753,309 B2
(45) Date of Patent: Aug. 25, 2020

(54) INTAKE PASSAGE STRUCTURE FOR AN ENGINE

(71) Applicant: MITSUBISHI JIDOSHA KOGYO KABUSHIKI KAISHA, Tokyo (JP)

(72) Inventors: Yoshiaki Ishiura, Tokyo (JP); Mitsutaka Kojima, Tokyo (JP); Shinichi Murata, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 96 days.

(21) Appl. No.: 16/306,036

(22) PCT Filed: Feb. 24, 2017

(86) PCT No.: PCT/JP2017/007166
§ 371 (c)(1),
(2) Date: Nov. 30, 2018

(87) PCT Pub. No.: WO2018/003168
PCT Pub. Date: Jan. 4, 2018

(65) Prior Publication Data

US 2019/0128211 A1 May 2, 2019

(30) Foreign Application Priority Data

Jun. 27, 2016 (JP) ..... 2016-126617

(51) Int. Cl.
*F02F 1/42* (2006.01)
*F02M 35/10* (2006.01)
(Continued)

(52) U.S. Cl.
CPC ..... *F02F 1/4257* (2013.01); *F02F 1/24* (2013.01); *F02F 1/42* (2013.01); *F02F 11/002* (2013.01);
(Continued)

(58) Field of Classification Search
CPC .... F02F 1/4257; F02F 1/24; F02F 1/42; F02F 11/002; F02F 2001/249; F02M 35/10347;
(Continued)

(56) References Cited

U.S. PATENT DOCUMENTS 5,552,196 A 9/1996 Haselkorn et al.
5,842,342 A * 12/1998 Strasser ..... C04B 35/80 60/282
(Continued)

FOREIGN PATENT DOCUMENTS

DE 19833618 A1 1/2000
JP 58-42347 U 3/1983
(Continued)

OTHER PUBLICATIONS

International Preliminary Report on Patentability and English translation of the Written Opinion (Forms PCT/IB/373 and PCT/ISA/237) for International Application No. PCT/JP2017/007166, dated Jan. 1, 2019.
(Continued)

*Primary Examiner* — Jacob M Amick
(74) *Attorney, Agent, or Firm* — Birch, Stewart, Kolasch & Birch, LLP.

(57) ABSTRACT

An intake passage structure for an engine includes an intake port in a cylinder head of the engine, and connected to a combustion chamber to define an intake passage. The intake passage structure further includes a heat insulating member disposed along an inner surface of the intake port, and including a bulge having an upstream end surface which is a portion of an upstream end surface of the heat insulating member, the bulge has a radially outwardly protruding radially outer surface and has an increased wall thickness. The wall thickness of the bulge increases from downstream to upstream of the intake port. The upstream end surface of
(Continued)

the bulge includes an injection machine connecting portion facing an injection gate configured to inject resin for forming the heat insulating member into the intake port.

14 Claims, 5 Drawing Sheets

(51) Int. Cl.

| | |
|---|---|
| ***F02M 53/04*** | (2006.01) |
| ***F02F 1/24*** | (2006.01) |
| ***F02M 53/00*** | (2006.01) |
| ***F02F 11/00*** | (2006.01) |
| ***F02M 35/104*** | (2006.01) |

(52) U.S. Cl.
CPC .... *F02M 35/104* (2013.01); *F02M 35/10347* (2013.01); *F02M 53/00* (2013.01); *F02M 53/046* (2013.01)

(58) Field of Classification Search
CPC ..... F02M 35/104; F02M 53/00; F02M 53/04; F02M 53/046
See application file for complete search history.

(56) References Cited

U.S. PATENT DOCUMENTS

| | | | | |
|---|---|---|---|---|
| 2004/0099238 | A1* | 5/2004 | Gould | F02F 1/24 123/193.5 |
| 2018/0216586 | A1* | 8/2018 | Netsu | F02F 1/42 |
| 2018/0347522 | A1* | 12/2018 | Ooki | F02M 35/10085 |
| 2020/0049059 | A1* | 2/2020 | Ikeya | F02B 31/04 |

FOREIGN PATENT DOCUMENTS

| | | | |
|---|---|---|---|
| JP | 62-165444 | U | 10/1987 |
| JP | 7-259642 | A | 10/1995 |
| JP | 2011-94515 | A | 5/2011 |
| JP | 2016-114021 | A | 6/2016 |

OTHER PUBLICATIONS

International Search Report (Form PCT/ISA/210) for International Application No. PCT/JP2017/007166, dated Mar. 28, 2017.
Japanese Office Action for Japanese Application No. 2016-126617, dated Feb. 25, 2020, with Machine English translation.

* cited by examiner

INTAKE PASSAGE STRUCTURE FOR AN ENGINE

TECHNICAL FIELD

The present invention relates to an intake passage structure for an engine which achieves favorable combustion in a combustion chamber.

BACKGROUND ART

Air is fed into a combustion chamber of an engine through an intake passage in the intake manifold (hereinafter referred to as the "intake manifold passage") and an intake passage in the cylinder head (hereinafter referred to as the "intake port").

Since the intake manifold and the cylinder head are heated by heat transferred from the combustion chamber, suction air tends to be heated by heat from the inner surfaces of the intake manifold passage and the intake port.

Especially in a high-compression-ratio engine, an increased suction air temperature tends to cause knocking more frequently than in a low-compression-ratio engine. To prevent knocking, it is necessary to e.g., retard the ignition timing. Since retarding the ignition timing worsens fuel economy, it is desired to minimize the temperature rise of the suction air.

To minimize the temperature rise of the suction air, the below-identified Patent Document 1 proposes a heat insulating member for suction air which comprises a material low in thermal conductivity, such as resin, and closely adhered to the inner surface of the intake port, which is made of metal.

PRIOR ART DOCUMENT

Patent Document

Patent Document 1: JP H7-259642A

SUMMARY OF THE INVENTION

Object of the Invention

When forming a member by injecting resin into a mold form, the formation of weld lines is inevitable in many cases. This is also the case when forming a heat insulating member on the inner surface of the intake port by resin injection molding.

Weld lines form especially when molten resin in a mold frame is divided into multiple flows to avoid an obstacle, at positions where the portions of the resin divided into multiple flows to avoid the obstacle meet again. This is because the leading ends of the portions of the resin flowing in different directions in the mold frame cool down most quickly and thus hardens first, and the divided portions are integrated by the cooled and hardened leading ends merging each other.

Weld lines appear on the surface of a molded product, and are visually recognizable as thin lines. Ribs and/or grooves may form along such weld lines. Besides weld lines, the position of the molded product that has been opposed to an injection gate through which molten resin is injected also appears on the surface of the molded product, and is thus visually recognizable, as e.g., a circular protrusion or contour in plan view.

Especially in the case of a heat insulating member in the intake port, undulations on the inner surface of the heat insulating member could interfere with the flow of suction air. It is therefore desired to avoid the formation of such undulations.

A conventional injection gate is disposed at an intermediate portion of the intake port in the flow direction of air in the intake port, and comprises a through hole extending upwardly from the bottom of the cylinder head and communicating with the interior space in the intake port.

With the injection gate disposed at the described position, resin injected into the intake port divides into an upstream flow and a downstream flow, and the respective flows are turned and merge somewhere at an intermediate portion of the intake portion in the air flow direction. As a result, a weld line (in the form of a rib or a groove) that extends in a direction crossing the air flow direction tends to form. A weld line in a direction crossing the air flow direction resists and interferes with the flow of suction air, and thus is not preferable.

An object of the present invention is to prevent the formation of weld lines that could interfere with the flow of suction air on a heat insulating member formed in the intake port by injection molding.

Means for Achieving the Object

In order to achieve the above object, the present invention provides an intake passage structure for an engine, comprising: an intake port disposed in a cylinder head of the engine, and connected to a combustion chamber, the intake port defining an intake passage; and a heat insulating member disposed along an inner surface of the intake port, the heat insulating member including a bulge having an upstream end surface which is a portion of an upstream end surface of the heat insulating member, and a radially outer surface protruding radially outwardly beyond a radially outer surface of a portion of the heat insulating member other than the bulge so that the bulge has a wall thickness larger than a wall thickness of the portion of the heat insulating member other than the bulge.

The bulge of the heat insulating member may have a maximum wall thickness portion where the wall thickness is the largest, the maximum wall thickness portion being located within a range between the upstream end surface of the heat insulating member and a downstream end surface of the heat insulating member.

The maximum wall thickness portion may be located at the upstream end surface of the heat insulating member.

The wall thickness of the bulge may increase toward the maximum wall thickness portion of the bulge at the upstream end surface of the heat insulating member, from a downstream side of the intake port.

The upstream end surface of the bulge may include an injection machine connecting portion facing an injection gate configured to inject resin for forming the heat insulating member into the intake port.

The intake passage structure may further comprise an intake manifold connected to the cylinder head, and defining, in cooperation with the intake port, the intake passage. The intake manifold includes at a downstream end thereof a flange connected to the intake port, the flange including a bulged flange portion opposed to the bulge so as to correspond to the upstream end surface of the bulge.

The downstream end of the intake manifold and an upstream end of the intake port may define seal surfaces between the flange and the cylinder head.

The bulge may be disposed on a lower side of the intake port.

The bulge may be one of two bulges of the intake passage structure that are opposed to each other across a center of a flow passage cross-section of the intake port.

Advantages of the Invention

According to the present invention, the heat insulating member disposed along the inner surface of the intake port includes a bulge having an upstream end surface which is a portion of an upstream end surface of the heat insulating member, and having a radially outer surface protruding radially outwardly beyond the radially outer surface of the portion of the heat insulating member other than the bulge. Thus, by using the thick bulge as the injection port for injecting the material for the heat insulating member, it is possible to prevent the formation of weld lines that could interfere with the flow of suction air, on the heat insulating member in the intake port.

EMBODIMENTS

Figure 1A:
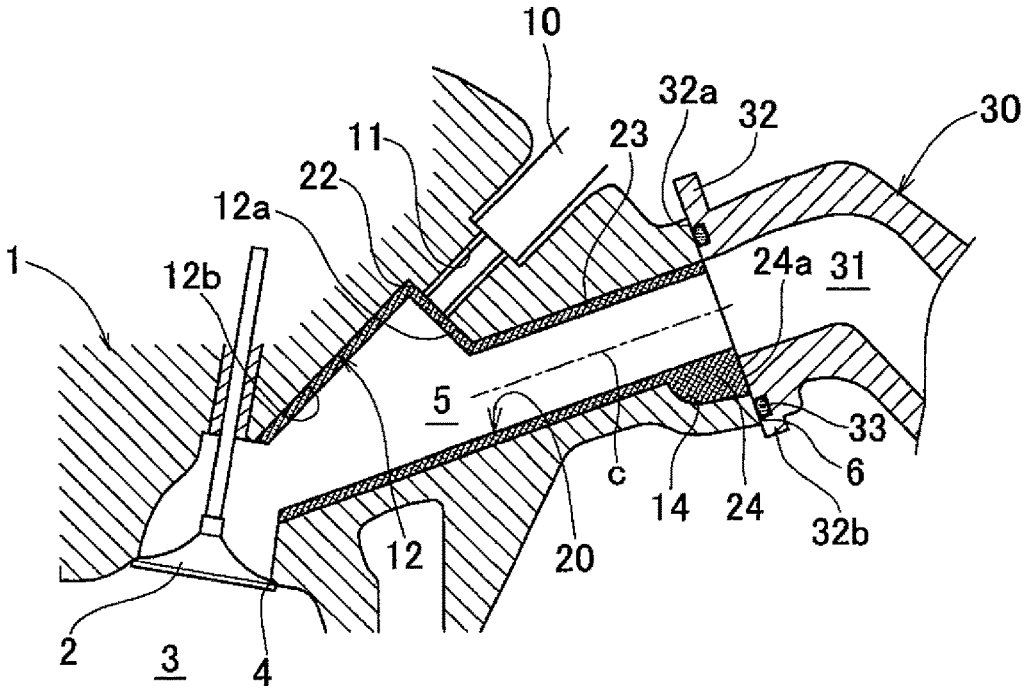
FIG. 1A is a sectional view of connecting portions of an intake port and an intake manifold passage according to an embodiment of the present invention.
Figure 1B:
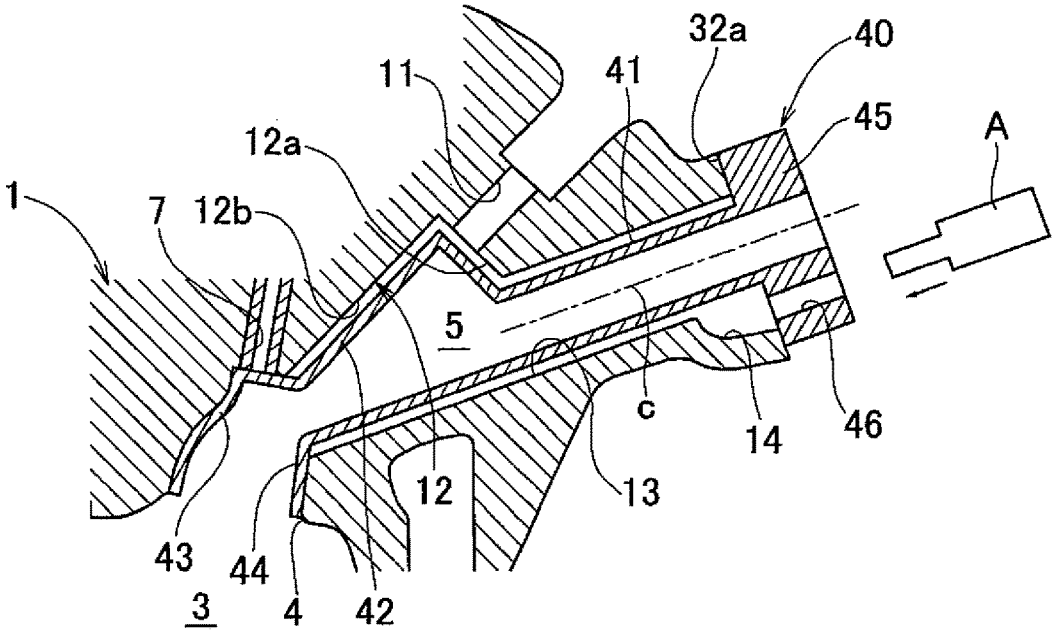
FIG. 1B is a sectional view of the embodiment of the present invention when a mold frame is mounted.

An embodiment of the present invention is described with reference to the drawings. FIG. 1A is a sectional view of an engine of the embodiment, showing a portion of a combustion chamber 3, a portion of a cylinder head 1, and a portion of an intake manifold 30 connected to the cylinder head 1. FIG. 1B is a similar sectional view showing how a heat insulating member 20 made of resin is formed in an intake port of the engine.

The engine has a cylinder in which a piston is received. The combustion chamber 3 is defined by a top surface and an inner peripheral surface of the cylinder, and the top surface of the piston. The cylinder head 1, located over the combustion chamber 3, includes the intake port 5 for feeding intake air into the combustion chamber 3, an exhaust port extending from the combustion chamber 3, and a fuel injector 10 for injecting fuel into the combustion chamber 3 or the intake port 5.

An intake valve hole 4 through which the intake port 5 communicates with the combustion chamber 3 is opened and closed by an intake valve 2. Similarly, an exhaust valve hole through which an exhaust port communicates with the combustion chamber 3 is opened and closed by an exhaust valve.

In FIGS. 1 and 2, members and means of the engine intake side, which directly concerns the present invention, are mainly shown, and other members of the engine are not shown. While only one cylinder is shown in FIGS. 1 and 2, the engine may be a single cylinder engine or a multi-cylinder engine, i.e., an engine having a plurality of cylinders.

As mentioned above, the intake manifold 30 is connected to the cylinder head 1, which includes the intake port 5. In the intake manifold 30, an intake manifold passage 31 is formed such that the intake manifold passage 31 and the intake port 5 constitute a portion of an intake line for supplying intake air introduced from the atmosphere through e.g., an air cleaner into the combustion chamber 3.

In this embodiment, the cylinder head 1 is made of a metal (aluminum), while the intake manifold 30 is made of a resin. However, the intake manifold 30 may be made of a metal such as a cast metal.

The intake port 5 has, at its upstream end portion connected to the intake manifold passage 31, a cross-section of a horizontally long oval shape, i.e., an oval shape of which the maximum distance between the upper and lower surfaces of the intake port 5 (i.e., the vertical diameter) is smaller than the maximum horizontal width of the intake port 5 (i.e., the diameter perpendicular to the vertical diameter). Similarly, the intake manifold passage 31 has, at its end connected to the intake port 5, a cross-section of a horizontally long oval shape, i.e., an oval shape of which the maximum distance between the upper and lower surfaces of the intake manifold passage 31 (i.e., the vertical diameter) is smaller than the maximum horizontal width of the intake manifold passage 31 (i.e., the diameter perpendicular to the vertical diameter).

The intake manifold 30 is fixed to the cylinder head 1 by inserting bolts extending from the cylinder head 1 through holes in a flange 32 at the downstream end of the intake manifold passage 31 of the intake manifold 30, and tightening the bolts with e.g., nuts. By tightening the nuts, the upstream end surface 6 of the intake port 5 comes into surface contact with an intake manifold end surface 32*a*, i.e., the downstream end surface of the intake manifold passage 31 such that the intake port 5 and the intake manifold passage 31 are airtightly connected together.

The intake manifold end surface 32*a* is formed with an annular seal groove in which an annular packing member 33 is received. When the nuts are tightened, the packing member 33 is pressed against the upstream end surface 6 of the intake port 5, thereby increasing airtightness between the two end surfaces.

A heat insulating member 20 is positioned on the inner surface of the intake port 5. The heat insulating member 20 has a predetermined thickness along the entire circumference of the inner surface of the intake port 5, and has, at its upstream portion close to the intake manifold 30, a tubular shape corresponding to the tubular inner surface portion 13 of the intake port 5. The portion of the heat insulating member 20 having the tubular shape is hereinafter referred to as the "tubular portion 23".

A mounting hole 11 for mounting the fuel injector 10 opens to the top surface of the intake port 5 in its downstream region close to the combustion chamber 3. The portion of the inner surface of the intake port 5 surrounding the mounting hole 11 forms a downwardly concave, mounting hole peripheral portion 12 including an upstream inclined surface 12*a* and a downstream inclined surface 12*b*.

The mounting hole 11 opens to the upstream inclined surface 12*a*, which faces the intake valve hole 4. In the region around the mounting hole peripheral portion 12 too, the heat insulating member 20 has a predetermined thickness along the entire circumference of the inner surface of the intake port 5. The portion of the heat insulating member 20 around the mounting hole peripheral portion 12 is hereinafter referred to as the "mounting hole periphery covering portion 22".

The heat insulating member 20 has, at the upstream end portion thereof, a bulge 24 which protrudes in a direction away from the center of the flow passage cross-section of the intake port 5. Thus, the bulge 24 is a portion of the heat insulating member 20 having a radially outwardly expanded radially outer surface and thus having an increased wall thickness.

The bulge 24 is formed at the upstream end portion of the heat insulating member 20 so as to include at least its upstream end surface, and has a maximum wall thickness portion where the wall thickness of the bulge 24 is the largest, the maximum wall thickness portion being located at a point of the heat insulating member 20 between the upstream end surface and the downstream end surface of the heat insulating member 20.

In the embodiment, the maximum wall thickness portion of the bulge 24 is located at the upstream end surface of the heat insulating member 20, and the wall thickness of the bulge 24 increases from the downstream side of the intake port 5 toward the maximum wall thickness portion at the upstream end surface of the heat insulating member 20.

Alternatively, the maximum wall thickness portion of the bulge 24 may be located at any point of the bulge 24 other than the upstream end surface of the heat insulating member 20, between the upstream and downstream ends of the bulge 24. In this case, the bulge 24 may be shaped such that its wall thickness increases gradually from the downstream end of the bulge 24 to the maximum wall thickness portion, and decreases gradually from the maximum wall thickness portion to the upstream end of the bulge 24.

Figure 3A:
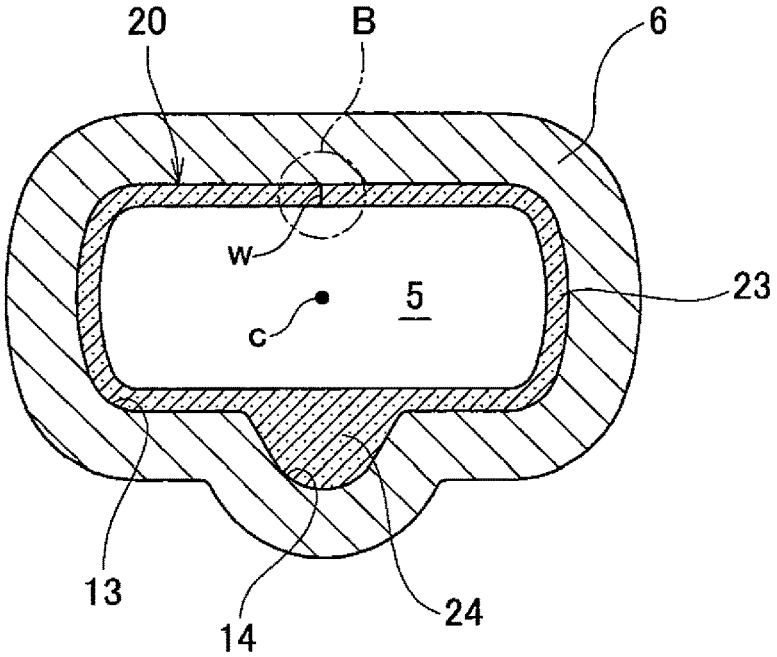
FIG. 3A is a sectional view of the intake port.
Figure 3B:
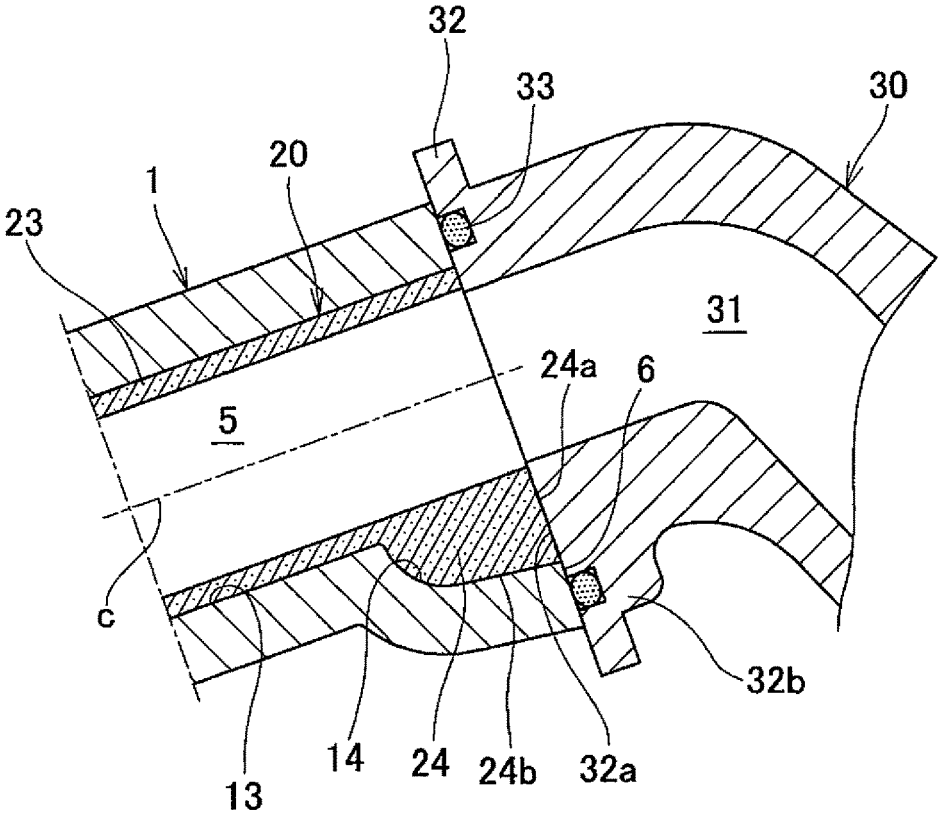
FIG. 3B is a vertical sectional view of the embodiment after the intake port and the intake manifold passage are connected together.

The above-mentioned "center of the flow passage cross-section of the intake port 5" corresponds to, as shown in FIGS. 3A and 3B, which show such flow passage cross-section, the centerline c of the space through which the intake air in the intake port 5 flows. That is, the center line c is the center of the space through which intake air flows, both in the vertical direction and in the width direction, which is perpendicular to the vertical direction.

Corresponding to the bulge 24, the inner surface of the intake port 5 has, at its upstream end portion, a bulge-forming recess 14 into which the bulge 24 is received.

The bulge-forming recess 14 is located upstream of the tubular inner surface portion 13 of the intake port 5, and is recessed downwardly from the tubular inner surface portion 13 in the direction outwardly away from the center of the flow passage cross-section of the intake port 5. The bulge-forming recess 14 opens to the upstream end surface 6 of the intake port 5.

The inner surface of the bulge-forming recess 14 gradually approaches the center of the flow passage cross-section of the intake port 5, from the upstream end surface 6 of the intake port 5 toward the tubular inner surface portion 13, which is located downstream of the bulge-forming recess 14. As a result, the contact surface 24*b* between the bulge 24 and the bulge-forming recess 14 also gradually approaches the center of the flow passage cross-section of the intake port 5, from upstream to downstream of the intake port 5.

In this embodiment, the contact surface 24*b* between the bulge 24 and the bulge-forming recess 14 is inclined in an arc shape, as viewed in section along the flow direction between upstream and downstream of the intake port 5 (direction of the centerline e). However, the contact surface 24*b* may be inclined in a straight line instead.

While in the embodiment, a single bulge 24 and a corresponding single bulge-forming recess 14 are disposed on the underside of the air intake port 5, a plurality of bulges 24 and corresponding bulge forming recesses 14 may be disposed along the circumference of the flow passage cross-section.

The bulge 24 is arranged such that with the intake manifold 30 connected to the cylinder head 1 such that the intake port 5 communicates with the intake manifold passage 31, the upstream end surface 24*a* of the bulge 24 is in surface contact with the intake manifold end surface 32*a*, which is the downstream end surface of the flange 32 at the downstream end of the intake manifold passage 31.

The flange 32 of the intake manifold 30 includes, at its position opposed to the bulge 24 of the heat insulating member 20, a bulged flange portion 32*b* corresponding to the upstream end surface 24*a* of the bulge 24. The bulged flange portion 32*b* has an end surface which is in surface contact with the upstream end surface 24*a* of the bulge 24 and the end surface of the intake port 5. Thus, the downstream end of the intake manifold 30 and the upstream end of the intake port 5 define seal surfaces between the flange 32 and the cylinder head 1.

The heat insulating member 20 is formed by resin injection molding. The injection molding is carried out using a mold form 40 inserted in the intake port 5.

As shown in FIG. 1B, the mold form 40 includes a tubular portion 41 configured to be opposed to the tubular inner surface portion 13 and the bulge-forming recess 14, i.e., the upstream portion of the intake port 5. The mold form 40 further includes divided portions 42, 43, and 44 configured to be opposed to the vicinity of the mounting hole peripheral portion 12, i.e., the downstream portion of the intake port 5.

The tubular portion 41 of the mold form 40 is tubular in shape so as to be opposed to the tubular inner surface portion 13 of the intake port 5 with a predetermined gap left therebetween, and opposed to the bulge-forming recess 14 with a gap left therebetween which is larger than the gap between the tubular portion 41 and the tubular inner surface portion 13. The tubular portion 41 can be inserted into and taken out of the intake port 5 through the upstream opening of intake port 5.

The divided portions 42, 43, and 44 of the mold form 40 are complimentary in shape to the vicinity of the mounting hole peripheral portions 12 and configured to be opposed to the inner surface of the intake port 5 with a predetermined gap left therebetween. The divided portions 42, 43, and 44 are separate from each other so that they can be inserted into and removed from the intake port 5 through the downstream end of the intake port 5, which opens to the combustion chamber 3. The divided portions 42, 43, and 44 can be joined together in the intake port 5, and can be disconnected from each other, and taken out through the intake valve hole 4, after the resin has hardened.

The upstream end of the mold form 40 defines an upstream flange 45 to be in surface contact with the upstream end surface 6 of the intake port 5. The upstream flange 45 has an injection gate 46 extending through the upstream flange 45 in the thickness direction thereof, and open to the bulge-forming recess 14, which is a portion of the mold form space defined between the inner surface of the intake port 5 and the outer surface of the mold form 40. The bulge 24 is shaped such that the area of the upstream end surface 24*a* of the bulge 24 is larger than the sectional area of the injection gate 46, through which injected resin passes, and the height (vertical dimension) and the lateral width of the bulge 24 are both larger than the diameter of the injection gate 46 (which has a circular cross-section).

Figure 2A:
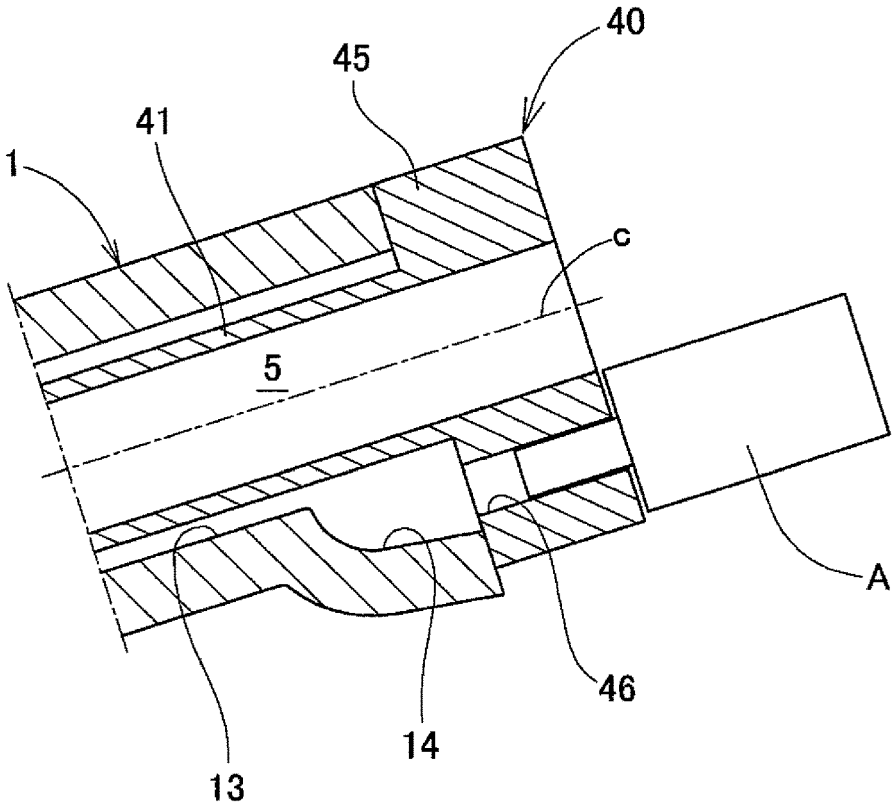
FIG. 2A is a vertical sectional view of the embodiment showing the mold frame disposed in the intake port, and an injection machine for injecting resin.

As shown in FIGS. 1B and 2A, with the mold form 40 inserted into the intake port 5 and fixed in position, the injection port of an injection machine A is inserted into the injection gate 46, and the mold form space between the inner surface of the intake port 5 and the outer surface of the mold form 40 is filled with resin injected from the injection machine A. Then, after the resin has hardened, the mold form 40 is removed to form the heat insulating member 20 fixedly attached to the inner surface of the intake port 5.

Figure 2B:
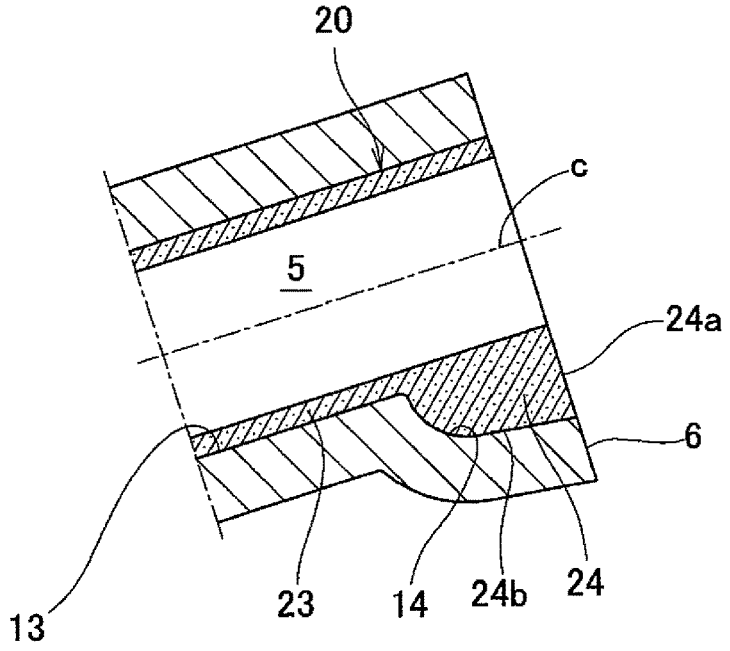
FIG. 2B is a vertical sectional view of the embodiment showing a finished heat insulating member formed by injecting resin.

The thus formed heat insulating member 20 is shown in FIG. 2B. In this arrangement, since the upstream end surface 24*a* of the bulge 24 is an injection machine connecting portion that faces the injection gate 46, through which the resin to be formed into the heat insulating member 20 is injected into the intake port 5, the heat insulating member 20 has a weld line w extending between upstream and downstream of the intake port 5.

That is, the resin injected from the injection machine A flows through the injection gate 46, and enters the mold form space through the injection machine connecting portion facing the injection gate 46 (i.e., through the upstream end surface of the bulge 24 of the heat insulating member 20 to be formed by the injected resin). The resin then moves from upstream to downstream, while moving in the opposite circumferential directions until its leading ends merge at a position opposite from the injection machine connecting portion, i.e., the upstream end surface of the bulge 24, across the center of the flow passage cross-section of the intake port 5, thus forming the weld line w at this position.

The weld line w forms because when the two separate masses of the molten resin collide against each other, they cool down and harden before they completely melt into each other. In the embodiment, as shown in FIG. 3, the weld line w forms at a position opposite from the injection machine connecting portion, i.e., the bulge 24 across the center of the flow passage cross-section of the intake port 5 (see letter B at the upper portion of FIG. 3A) so as to extend substantially in the direction of, i.e., substantially parallel to, the centerline c of the intake port 5.

Since, according to the present invention, the upstream end surface 24*a* of the bulge 24 of the heat insulating member 20 serves as the injection machine connecting portion, the injection gate 46 can be provided in the mold frame 40. This eliminates the necessity of providing an injection gate in the cylinder head 1 as in conventional arrangements, and thus simplifies the structure and increase the strength, of the cylinder head 1.

Another advantage of using the upstream end surface 24*a* of the bulge 24 of the heat insulating member 20 as the injection machine connecting portion is that it is not necessary to use a seal plug to fill the injection gate 46 after the resin has hardened. Furthermore, the injection gate 46 will never affects the flow of intake air in the intake port 5.

Moreover, since the weld line w forms in the direction of the centerline c of the intake port 5, the undulation resulting from such weld line w will never affect the flow of intake air.

Furthermore, the thick-walled bulge 24, as the injection machine connecting portion, provides an anchoring effect to the heat insulating member 20, that is, the bulge 24 increases the adhesion between the heat insulating member 20, which is made of resin, and the intake port 5, made of metal, thereby preventing displacement therebetween under external forces or due to shrinkage with time.

By configuring the bulge 24 such that it includes the upstream end surface of the heat insulating member 20 and such that the maximum wall thickness portion of the bulge 24, i.e., its portion where the wall thickness is the largest, is located at the upstream end surface of the heat insulating member 20, the heat insulating member 20 can be formed without disturbing the flow of resin in the mold frame 40. However, the position of the maximum wall thickness portion of the bulge 24 is not limited at the upstream end surface of the heat insulating member 20. That is, if the maximum wall thickness portion of the bulge 24 is disposed at any point between the upstream end surface and the downstream end surface of the heat insulating member 20, the bulge 24 will effectively prevent separation of the heat insulating member 20 from the intake port 5, and allow the heat insulating member 20 to more effectively insulate intake air from heat.

By the provision of the bulge 24 and the corresponding bulge forming recess 14, the intake manifold 30 can be more rigidly fixed to the cylinder head 1. This is because the bulge 24 and the bulge forming recess 14 increase the contour of the contact portion between the upstream end surface 6 of the intake port 5 and the flange 32 of the intake manifold passage 31, and thus the contact area therebetween. The upstream end surface 24*a* of the bulge 24 is prevented from moving upstream by abutting the end surface 32*a* of the bulged flange portion 32*b*, which is formed on part of the flange 32 of the intake manifold passage 31. The bulged flange portion 32*b* is disposed at a position corresponding to the upstream end surface 24*a* of the bulge 24 to cover the upstream end surface 24*a*.

Figure 4A:
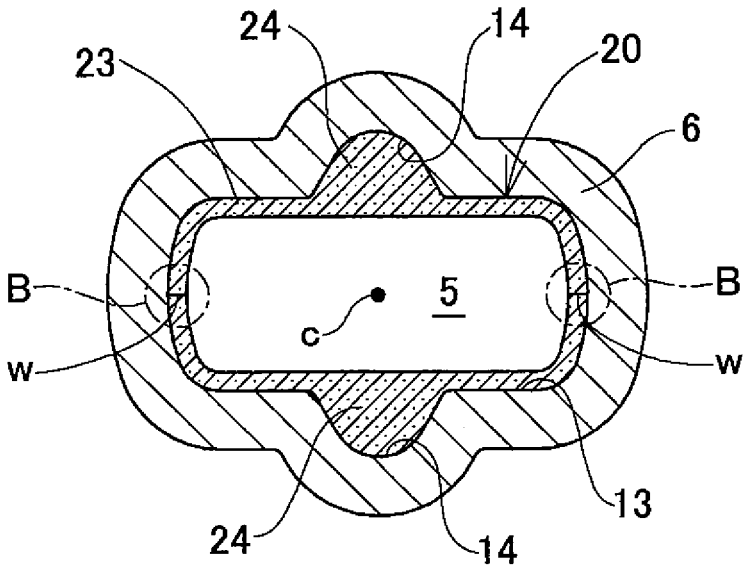
FIG. 4A is a sectional view of an intake port of another embodiment.
Figure 4B:
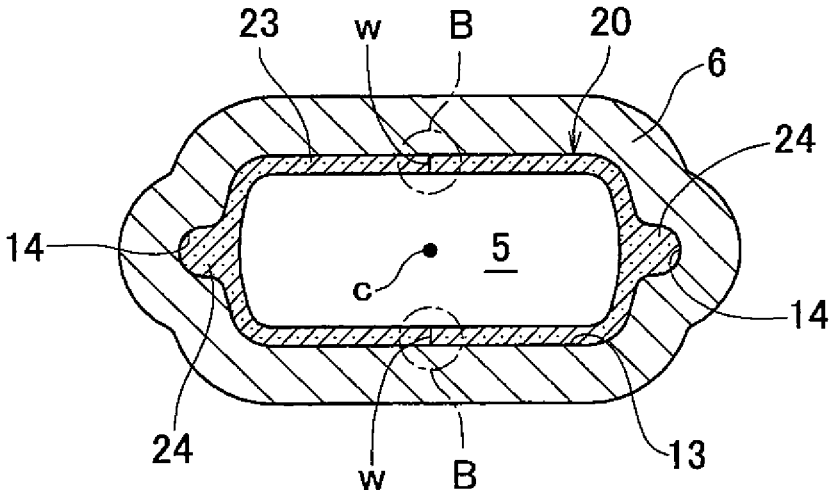
FIG. 4B is a sectional view of an intake port of still another embodiment.
Figure 4C:
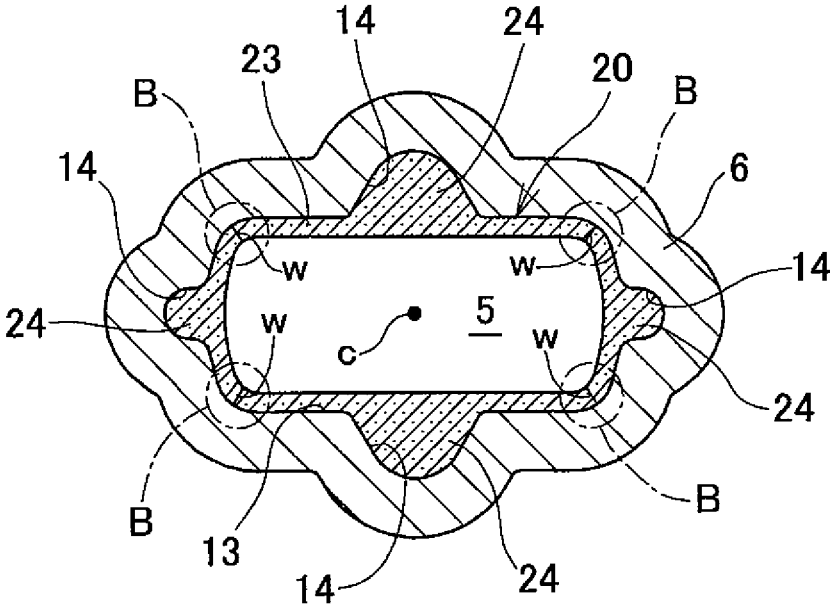
FIG. 4C is a sectional view of an intake port of yet another embodiment.

FIGS. 4A-4C show other embodiments, in which a plurality of bulges 24, and bulge forming recesses 14 corresponding to the respective bulges 24 are disposed around the flow passage cross-section of the intake port 5.

In the embodiment of FIG. 4A, two bulges 24 (and corresponding two bulge forming recesses 14) are disposed so as to be vertically opposed to each other across the center of the flow pass cross-section of the intake port 5, and two injection gates 46 are opposed to the respective upper and lower bulge forming recesses 14.

By providing two injection gates 46 so as to be opposed to each other across the center of the flow passage cross-section of the intake port 5, the resin can be filled more uniformly, the heat insulating member has a more uniform wall thickness, and the heat insulating member can be formed in a shorter period of time. This improves the adhesion between the resin forming the heat insulating member 20 and the metal forming the inner surface of the intake port 5. Further, by providing the injection gates 46 so as to be vertically opposed to each other, two weld lines w form on the right and left of the center of the flow passage cross-section of the intake port 5. This minimizes undulations near the top and bottom of the inner surface of the intake port 5, which could disturb the tumble flow of the intake air in the combustion chamber 3.

If the engine includes more than one cylinder, and the distance between the intake ports 5 of adjacent cylinders is short, the two bulges 24 (and thus the two bulge forming recesses 14) are preferably disposed above and below the intake port 5, respectively, as in the embodiment of FIG. 4A, to ensure installation space and for maintenance.

In FIG. 4B, two bulges 24 (and corresponding two bulge forming recesses 14) are disposed on the right and left of the center of the flow pass cross-section of the intake port 5, respectively, and two injection gates 46 are opposed to the respective right and left bulge forming recesses 14.

By providing two injection gates 46 on the right and left of the center of the flow passage cross-section of the intake port 5, two weld lines w form above and below the center of the flow passage cross-section of the intake port 5. By arranging two bulges 24 (and thus two bulge forming recesses 14) on the right and left of the intake port 5 as in the embodiment of FIG. 4B, a large installation space is created for the fuel injector 10.

In the embodiment of FIG. 4C, two bulges 24 (and corresponding two bulge forming recesses 14) are disposed so as to be vertically opposed to each other across the center of the flow pass cross-section of the intake port 5, and additional two bulges 24 (and corresponding additional two bulge forming recesses 14) are disposed on the right and left of the center of the flow pass cross-section of the intake port 5, respectively. Four injection gates 46 are opposed to the respective upper and lower, and right and left bulge forming recesses 14.

By providing two vertically opposed injection gates 46 and two additional horizontally opposed injection gates 46, weld lines form at the upper left, upper right, lower left, and lower right corners so as to be opposed to each other across the center of the flow passage cross-section of the intake port 5. Also, by providing four injection gates 46 in this manner, as in the previously described embodiments, the resin can be filled more uniformly, the heat insulating member has a more uniform wall thickness, and the heat insulating member can be formed in a shorter period of time. Moreover, since it is possible to reduce the amount of resin injected through one injection gate 46, it is possible to reduce the sectional area of each injection gate 46.

DESCRIPTION OF THE REFERENCE NUMERALS

1. Cylinder head
2. Intake valve
3. Combustion chamber
4. Intake valve hole
5. Intake port
6. Upstream end surface
7. Valve insertion hole
10. Fuel injector
11. Mounting hole
12. Mounting hole peripheral portion
13. Tubular inner surface portion
14. Bulge forming recess
20. Heat insulating member
22. Mounting hole periphery covering portion
23. Tubular portion
24. Bulge
30. Intake manifold
31. Intake manifold passage
32. Flange
32*a*. End surface (of intake manifold)
33. Packing
40. Mold form
41. Tubular portion
42, 43, 44. Divided portion
45. Upstream flange
46. Injection gate
w. Weld line

What is claimed is:

1. An intake passage structure for an engine, comprising:

an intake port disposed in a cylinder head of the engine, and connected to a combustion chamber, the intake port defining an intake passage; and a heat insulating member disposed along an inner surface of the intake port, the heat insulating member including a bulge having an upstream end surface which is a portion of an upstream end surface of the heat insulating member, and a radially outer surface protruding radially outwardly beyond a radially outer surface of a portion of the heat insulating member other than the bulge so that the bulge has a wall thickness larger than a wall thickness of the portion of the heat insulating member other than the bulge, wherein an upstream end portion side of the bulge includes an injection machine connecting portion facing an injection gate configured to inject resin for forming the heat insulating member into the intake port, and wherein the heat insulating member has a weld line located opposite from the bulge as the injection machine connecting portion, across a center of a flow passage cross-section of the intake port.

2. The intake passage structure of claim 1, wherein the bulge of the heat insulating member has a largest wall thickness portion where the wall thickness is largest, the largest wall thickness portion being located within a range between the upstream end surface of the heat insulating member and a downstream end surface of the heat insulating member.

3. The intake passage structure of claim 2, wherein the largest wall thickness portion is located at the upstream end surface of the heat insulating member.

4. The intake passage structure of claim 3, wherein the wall thickness of the bulge increases toward the largest thickness portion of the bulge at the upstream end surface of the insulating member, from a downstream side of the intake port.

5. The intake passage structure of claim 1, further comprising an intake manifold connected to the cylinder head, and defining, in cooperation with the intake port, the intake passage, the intake manifold including at a downstream end thereof a flange connected to the intake port, the flange including a bulged flange portion opposed to the bulge and so as to correspond to the upstream end surface of the bulge.

6. The intake passage structure of claim 5, wherein the downstream end of the intake manifold and an upstream end of the intake port define seal surfaces between the flange and the cylinder head.

7. The intake passage structure of claim 1, wherein the bulge is disposed on a lower side of the intake port.

8. The intake passage structure of claim 1, wherein the bulge is one of two bulges of the intake passage structure that are opposed to each other across the center of the flow passage cross-section of the intake port.

9. The intake passage structure of claim 2, further comprising an intake manifold connected to the cylinder head, and defining, in cooperation with the intake port, the intake passage, the intake manifold including at a downstream end thereof a flange connected to the intake port, the flange including a bulged flange portion opposed to the bulge and so as to correspond to the upstream end surface of the bulge.

10. The intake passage structure of claim 3, further comprising an intake manifold connected to the cylinder head, and defining, in cooperation with the intake port, the intake passage, the intake manifold including at a downstream end thereof a flange connected to the intake port, the flange including a bulged flange portion opposed to the bulge and so as to correspond to the upstream end surface of the bulge.

11. The intake passage structure of claim 4, further comprising an intake manifold connected to the cylinder head, and defining, in cooperation with the intake port, the intake passage, the intake manifold including at a downstream end thereof a flange connected to the intake port, the flange including a bulged flange portion opposed to the bulge and so as to correspond to the upstream end surface of the bulge.

12. The intake passage structure of claim 9, wherein the downstream end of the intake manifold and an upstream end of the intake port define seal surfaces between the flange and the cylinder head.

13. The intake passage structure of claim 10, wherein the downstream end of the intake manifold and an upstream end of the intake port define seal surfaces between the flange and the cylinder head.

14. The intake passage structure of claim 11, wherein the downstream end of the intake manifold and an upstream end of the intake port define seal surfaces between the flange and the cylinder head.

* * * * *